US012616296B2

(12) United States Patent
Albrecht

(10) Patent No.: US 12,616,296 B2
(45) Date of Patent: May 5, 2026

(54) DEVICE FOR PRODUCING BRISTLE PRODUCTS

(71) Applicant: Zahoransky AG, Todtnau (DE)

(72) Inventor: Christoph Albrecht, Todtnau (DE)

(73) Assignee: Zahoransky AG, Todtnau (DE)

( * ) Notice: Subject to any disclaimer, the term of this patent is extended or adjusted under 35 U.S.C. 154(b) by 497 days.

(21) Appl. No.: 18/271,255

(22) PCT Filed: Dec. 20, 2021

(86) PCT No.: PCT/EP2021/086888
§ 371 (c)(1),
(2) Date: Jul. 7, 2023

(87) PCT Pub. No.: WO2022/171340
PCT Pub. Date: Aug. 18, 2022

(65) Prior Publication Data

US 2024/0057756 A1 Feb. 22, 2024

(30) Foreign Application Priority Data

Feb. 10, 2021 (DE) ..... 102021103157 .5

(51) Int. Cl.
*A46D 3/04* (2006.01)
*A46D 3/08* (2006.01)

(52) U.S. Cl.
CPC ..... *A46D 3/042* (2013.01); *A46D 3/082* (2013.01); *A46D 3/087* (2013.01)

(58) Field of Classification Search
CPC ..... A46D 3/04; A46D 3/042; A46D 3/045; A46D 3/047; A46D 3/08; A46D 3/082; A46D 3/085; A46D 3/087
USPC ..... 300/2, 4, 5, 7, 8, 9, 10, 17, 21; 15/167.1
See application file for complete search history.

(56) References Cited

U.S. PATENT DOCUMENTS

| | | | | |
|---|---|---|---|---|
| 1,467,364 | A * | 9/1923 | Fisher | A46D 3/042 300/5 |
| 2005/0001468 | A1* | 1/2005 | Boucherie | A46D 3/042 300/5 |
| 2015/0374116 | A1* | 12/2015 | Steinebrunner | A46B 3/16 300/5 |

FOREIGN PATENT DOCUMENTS

| | | |
|---|---|---|
| DE | 102004011447 | 9/2005 |
| DE | 202015009043 | 9/2016 |
| DE | 102016014653 | 2/2018 |
| DE | 102017120029 | 2/2019 |
| GB | 868010 | 5/1961 |

* cited by examiner

*Primary Examiner* — Brian D Keller
*Assistant Examiner* — Alberto Saenz
(74) *Attorney, Agent, or Firm* — Volpe Koenig

(57) ABSTRACT

A device used in the technical field of producing bristle products. The device (1) includes a tufting tool (3) for tufting bundles of bristles (4) into a provided bristle carrier (5) and a bristle displacer (6) for displacing already tufted bundles of bristles from a tufting region of the tufting tool (3). The tufting tool (3) and the bristle displacement element (6) are connected to a common drive shaft (9) of the device via a respective coupling gear mechanism (7) and/or (8) and are driven by same.

18 Claims, 12 Drawing Sheets

DEVICE FOR PRODUCING BRISTLE PRODUCTS

CROSS-REFERENCE TO RELATED APPLICATIONS

This application is a 371 National Phase of International Application No. PCT/EP2021/086888, filed Dec. 20, 2021, which claims priority to German Patent Application No. 10 2021 103 157.5, filed Feb. 10, 2021, both of which are incorporated herein by reference as if fully set forth.

TECHNICAL FIELD

The invention relates to an apparatus for producing brushware, in particular brushes or brooms, having a tufting tool for tufting bristle bundles into a provided bristle carrier, and having a bristle displacer for displacing already tufted bristle bundles from a tufting region of the tufting tool.

BACKGROUND

Such apparatuses are already known from practice and also from the published prior art in different embodiments—such as for example from the document GB 868 010 A and the document DE 10 2004 011 447 A1.

In the case of the apparatuses already known from these two documents, it is provided that, during the tufting process, bristle displacers in the form of plates or sheets are directly acted on, and consequently moved, by the tufting tool of the respective apparatus.

In principle, said apparatuses function well. However, as tufting speed, that is to say number of bristle bundles tufted per unit time, increases, the already known concepts reach their limits.

SUMMARY

It is therefore an object of the invention to provide an apparatus of the type mentioned in the introduction that allows production of brushware even at relatively high tufting speeds.

To achieve said object, an apparatus of the type mentioned in the introduction that has one or more of the means and features disclosed herein, which is directed toward such an apparatus, is proposed. In particular, for achieving the object in the case of an apparatus of the type mentioned in the introduction, it is thus proposed that the tufting tool, via a tool coupling gear mechanism, and the bristle displacer, via a displacer coupling gear mechanism, are connected to and driven by a common drive shaft of the apparatus.

In this way, a kinematic coupling between the tufting tool and the bristle displacer can be established without the bristle displacer having to be acted on directly by the tufting tool, as was hitherto known from practice and the prior art.

In the case of the apparatus according to the invention, it is possible to dispense with restoring springs which move the bristle displacers of the hitherto known apparatuses back into their starting position and which can constitute a limiting factor for the increase in the tufting speed.

The coupling between the common drive shaft and the tufting tool, and also the bristle displacer, can be configured in such a way that the return movement of the bristle displacer is forcibly coupled to the return movement of the tufting tool from a tufting position.

In this way, an increase in the tufting speed results in a corresponding increase in the transmission of power with regard to the bristle displacer.

In one embodiment of the apparatus, it is provided that the tool coupling gear mechanism comprises a tool eccentric and the displacer coupling gear mechanism comprises a displacer eccentric. In this case, the tool eccentric and the displacer eccentric may be arranged on the common drive shaft.

With the aid of the two eccentrics, the rotational movement of the common drive shaft can be converted into a corresponding movement of the tufting tool and of the bristle displacer.

In a preferred embodiment of the apparatus, for performing a displacer movement, the bristle displacer is pivotable about an axis of rotation. In this case, the axis of rotation may be oriented parallel or at a right angle or transversely to the movement direction of the tufting tool during tufting of bristles.

In the case of an axis of rotation of the bristle displacer that is oriented transversely or at a right angle to the movement direction of the tufting tool, the bristle displacer may be moved in an arc-shaped or circular-arc-shaped displacer movement. If the axis of rotation of the bristle displacer is oriented parallel to the movement direction of the tufting tool, the displacer movement of the bristle displacer may be of fan-like form.

The apparatus may have a switching device for changing a displacer direction and/or a displacer travel of the bristle displacer.

In this way, it is possible to set the displacer direction in which the bristle displacer is advanced for displacing already tufted bristle bundles and/or the displacer travel of the bristle displacer that is covered by the bristle displacer. This facilitates production of brushware with relatively complex bristle fields whose bristle bundles are to be tufted in a particular sequence and which require a movement of the bristle displacer in different directions and/or with different adjustment travels.

In one embodiment of the apparatus of particular importance, the switching device comprises a guide carriage and a linear guide along which the guide carriage is displaceably mounted. In this case, an angular position of the linear guide may be changeable in order to set the displacer direction and/or the displacer travel of the bristle displacer.

The guide carriage and the linear guide may be constituent parts of the displacer coupling gear mechanism already mentioned above, via which the bristle displacer is coupled to the common drive shaft of the apparatus.

As already indicated above, a displacer direction of the bristle displacer and/or a displacer travel of the bristle displacer may be dependent on the angular position of the linear guide.

The guide carriage may be connected via at least one lever, in particular via at least one articulated lever, to the bristle displacer. In this way, the movement of the guide carriage can be transmitted to the bristle displacer. According to orientation and angular position of the linear guide along which the guide carriage is displaceable, the displacer travel and/or the displacer direction of the bristle bundle can thus be transmitted to the bristle displacer via the lever.

The guide carriage, for its part, may be connected via a transmission means of the displacer coupling gear mechanism, for example via a transmission lever, and/or via the displacer eccentric to the common drive shaft. In this way, it is possible for the movement of the drive shaft to be transmitted to the guide carriage.

A transmission means of the displacer coupling gear mechanism and a transmission means of the tool coupling gear mechanism may be arranged, in particular mounted, on a common spindle. In this case, the common spindle may be oriented transversely or parallel to the common drive shaft. As transmission means, use may be made of levers which are able to interact with the respective eccentric in order to convert the rotational movement of the common drive shaft into a movement of the tufting tool and of the bristle displacer.

The tool coupling gear mechanism may have a slotted guide for transmission of a drive movement to the tufting tool. The slotted guide may be arranged for example on the tufting tool. The aforementioned transmission means may be connected indirectly to the tufting tool via the slotted guide.

The tool eccentric and the displacer eccentric may be configured, and arranged on the common drive shaft, in such a way that the bristle displacer is arranged in the displacer position while the tufting tool is in the tufting position. In this way, collisions between the tufting tool and the bristle displacer can be avoided. It is also possible for the tool eccentric and the displacer eccentric to be configured, and arranged on the common drive shaft, in such a way that the bristle displacer has already assumed its displacer position before the tufting tool has reached its tufting position. In this way, collisions between the tufting tool and the bristle displacer can be avoided in a particularly reliable manner.

In one embodiment of the apparatus, the bristle displacer has a displacer ring into which the tufting tool projects in the tufting position. A collision between bristle displacer and tufting tool can be effectively avoided in this way.

Furthermore, with the aid of a displacer ring, a sufficiently large region of already tufted bristle bundles can be kept clear in a simple and, for the bristle bundles, gentle manner, it thus being possible for further bristle bundles to be tufted without neighboring bristle bundles being damaged or neighboring bristle bundles being inadvertently tufted in along therewith.

It may be advantageous for the interplay between tufting tool and bristle displacer if an outer circumferential surface of a tool tip of the tufting tool is formed so as to correspond to an inner circumferential surface of the displacer ring. In this way, the tufting tool can bear with its tool tip against the inner circumferential surface of the displacer ring.

In one embodiment of the apparatus, the bristle displacer may have at least one deflection means. As at least one deflection means, a displacer tip may be provided, for example. The at least one deflection means of the bristle displacer may be used to laterally deflect with respect to a movement direction of the bristle displacer bristle bundles which have already been tufted into a bristle carrier. Such a lateral displacement can be particularly gentle for the already tufted bristle bundles. A displacer tip may have laterally inclined displacer surfaces by way of which already tufted bristle bundles can be laterally displaced in a reliable and gentle manner.

In one embodiment of said bristle displacer, a longitudinal axis of the at least one deflection means may be oriented transversely or at a right angle to the movement direction of the bristle displacer. In the case of a bristle displacer having a displacer ring, the at least one deflection means may be arranged on an outer side of the displacer ring. In a preferred embodiment of a bristle displacer having a displacer ring, there are arranged on two mutually averted outer sides of the displacer ring in each case one deflection means in the form of a displacer tip.

The apparatus may have a motor for driving the common drive shaft. In this case, an output shaft of the motor may be connected via a drive belt to the drive shaft.

In order for it to be possible for a bristle carrier to be oriented relative to the tufting tool into the position which, for the tufting of its receiving holes, is required for bristle bundles in each case, it may be advantageous for the apparatus to have a holder for receiving at least one bristle carrier, which holder is adjustable relative to the tufting tool in at least two different axes.

The apparatus may furthermore have a magazine in which bristle filaments are stored. The bristle filaments, with the aid of a bundle separator of the apparatus, can, combined into bristle bundles, be removed from the magazine and supplied to the tufting tool. The apparatus may have an anchor-supply apparatus by way of which anchors, for fastening bristle bundles in a bristle carrier, can be supplied to the tufting tool of the apparatus.

BRIEF DESCRIPTION OF THE DRAWINGS

The invention will be described in more detail below on the basis of an exemplary embodiment, but is not restricted to this exemplary embodiment. Further exemplary embodiments of the invention emerge from combination of the features of individual or multiple claims with one another and/or in the combination of individual or multiple features of the exemplary embodiment discussed below. In the figures:

FIGS. 20 to 24 show views of a brush in different processing stages, wherein FIGS. 21 and 23 show displaced bristle bundles, in order to illustrate the way of working of the bristle displacer, which is able to be advanced from different directions.

DETAILED DESCRIPTION

Figure 1:
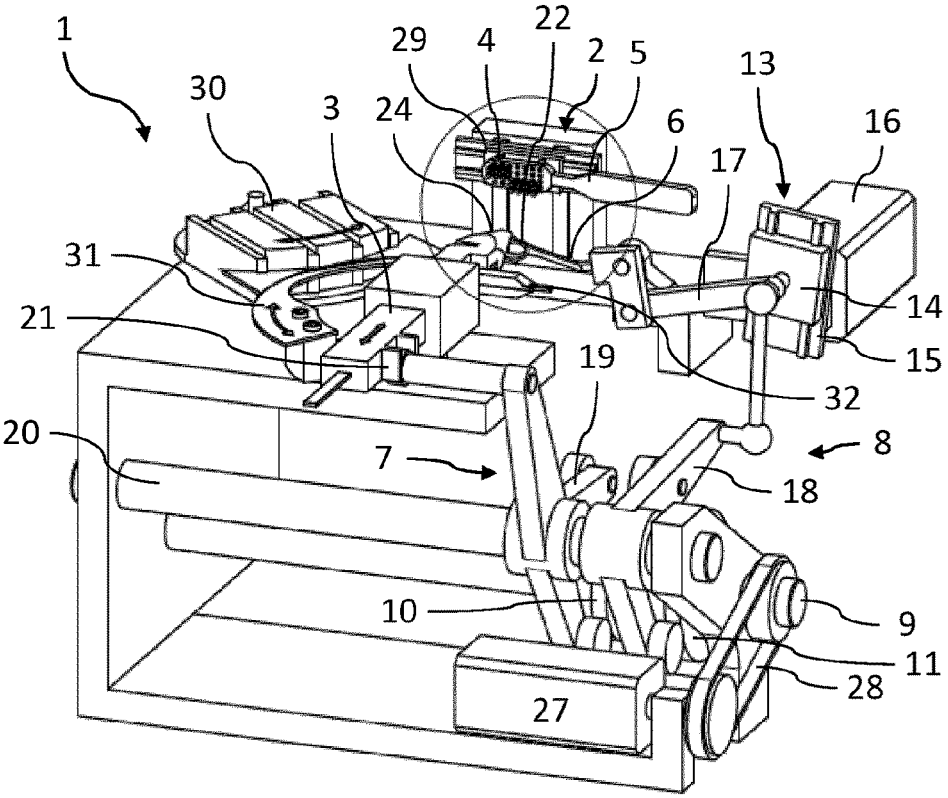
FIGS. 1 to 8 show views of an apparatus for producing brushware for illustrating the functioning of its tufting tool and of its bristle displacer during tufting of a lower partial field of a bristle carrier to be tufted with bristle bundles, wherein the bristle displacer is advanced in a displacer movement performed from the bottom upward.
Figure 2:
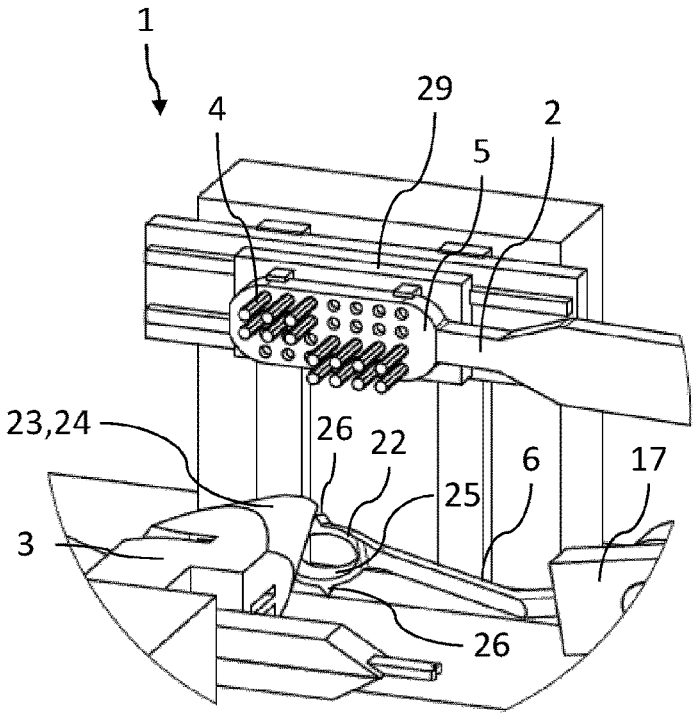
Figure 3:
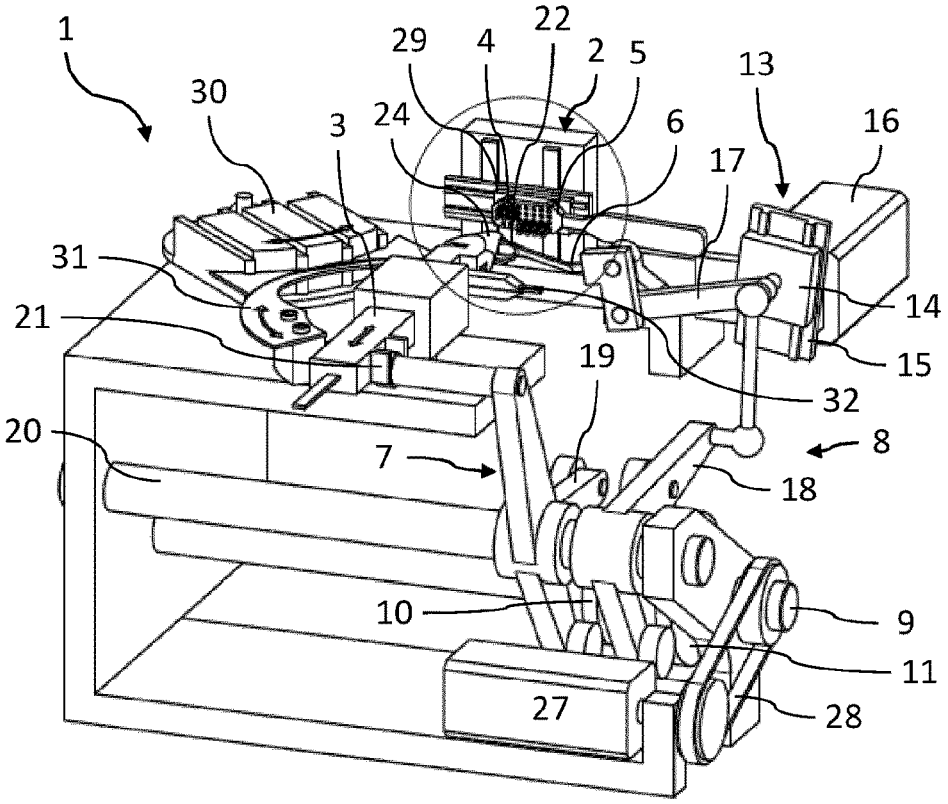
Figure 4:
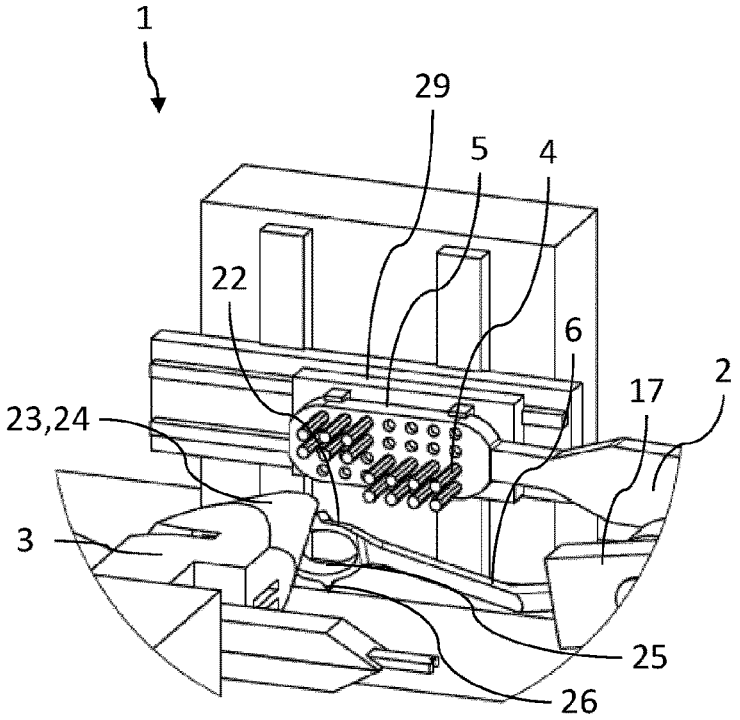
Figure 5:
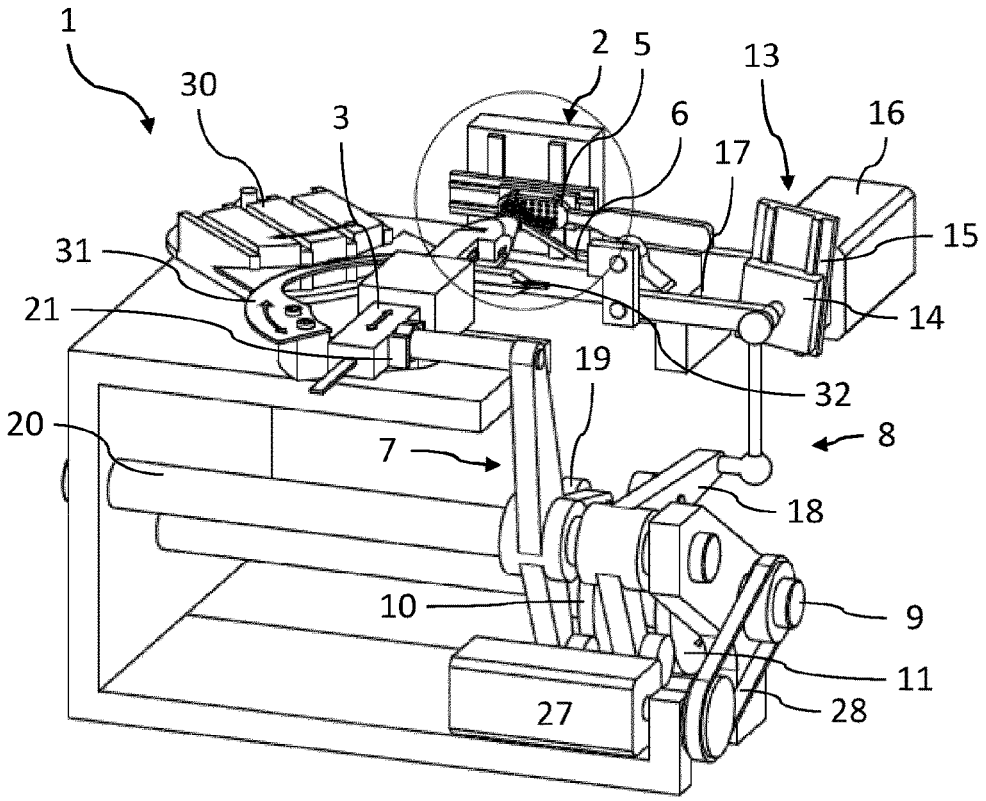
Figure 6:
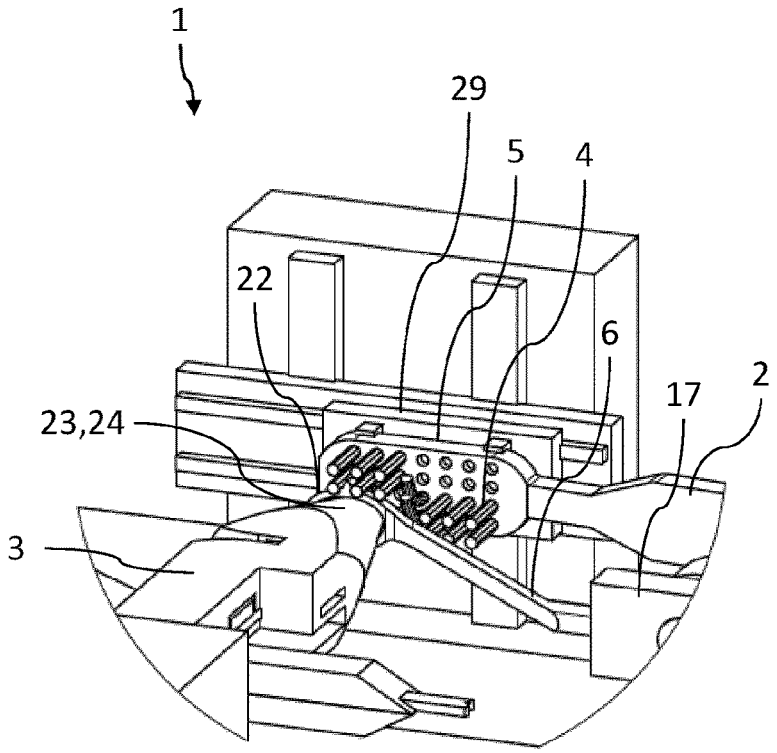
Figure 7:
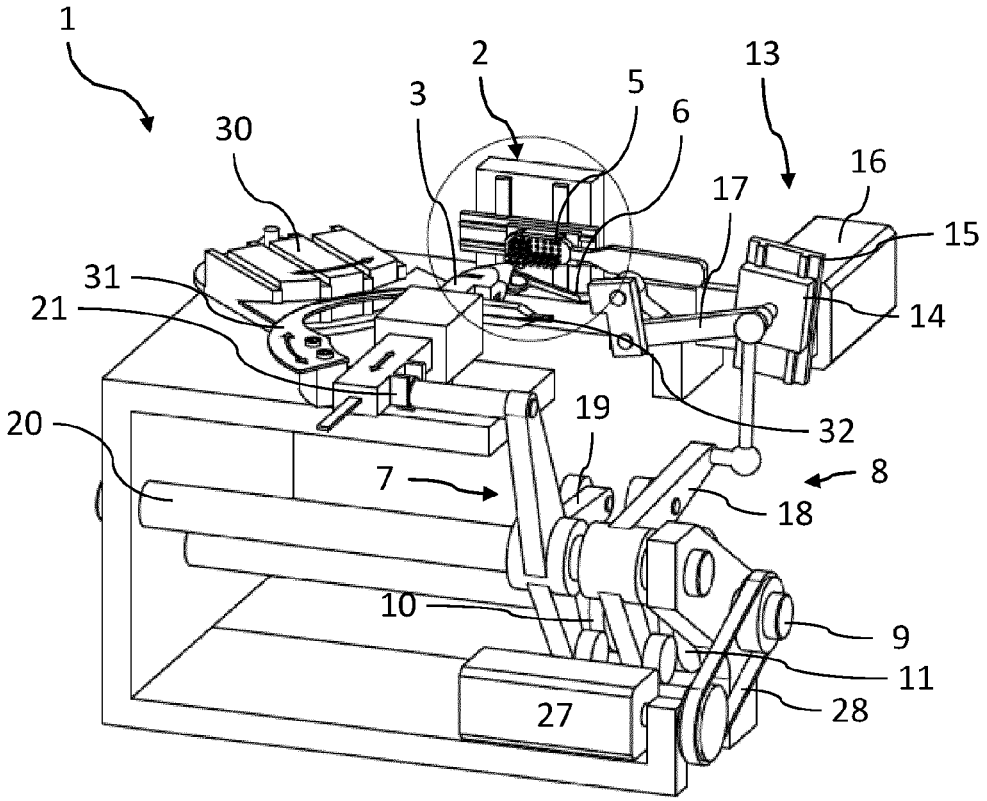
Figure 8:
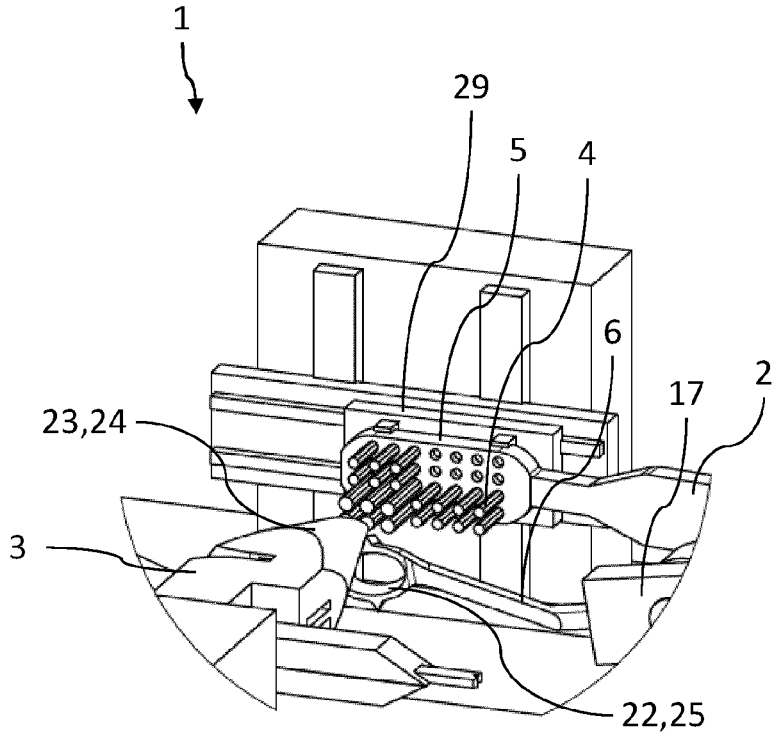
Figure 9:
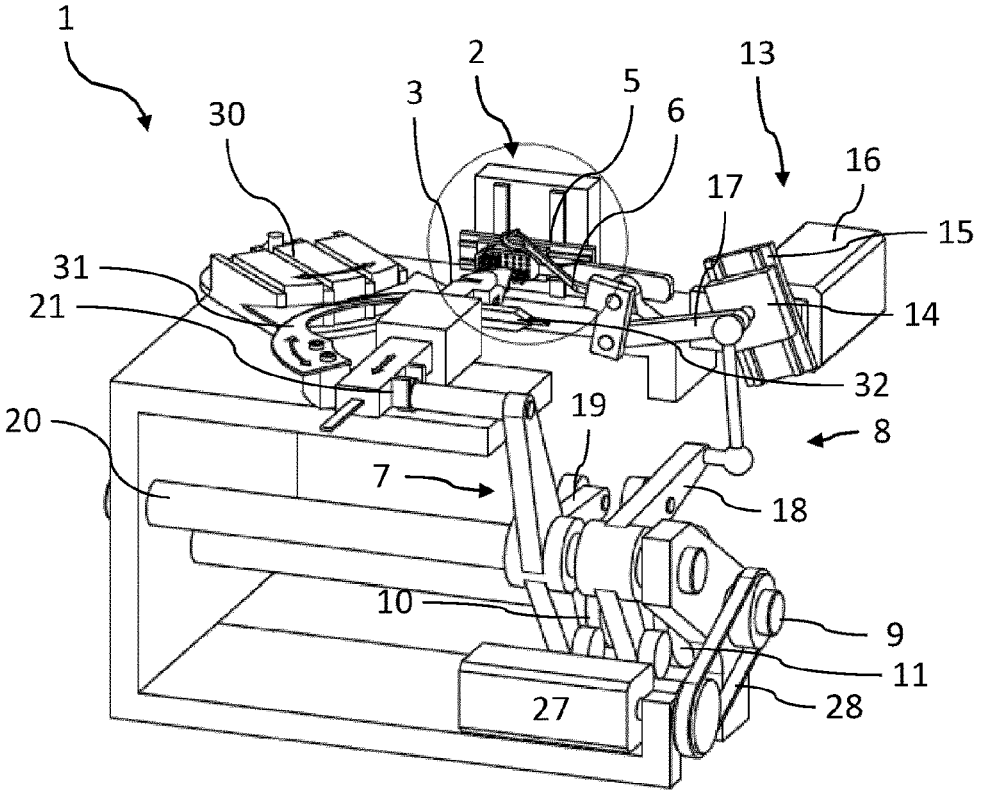
FIGS. 9 to 17 show illustrations of the apparatus shown in FIGS. 1 to 8 for illustrating the functioning of the apparatus during tufting of an upper partial field of a bristle carrier to be tufted, wherein in particular FIG. 17 makes clear that the bristle displacer has already reached its displacer position before the tufting tool reaches its tufting position.
Figure 10:
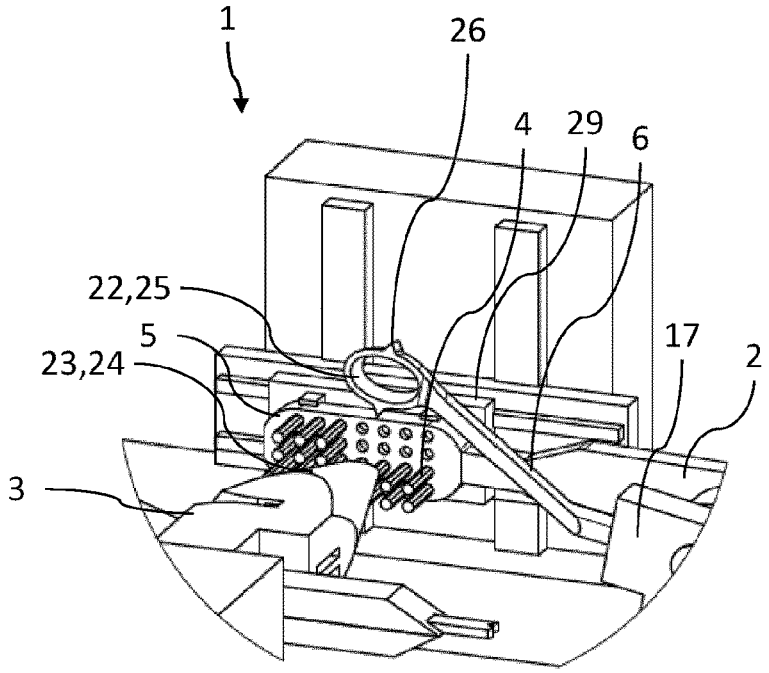
Figure 11:
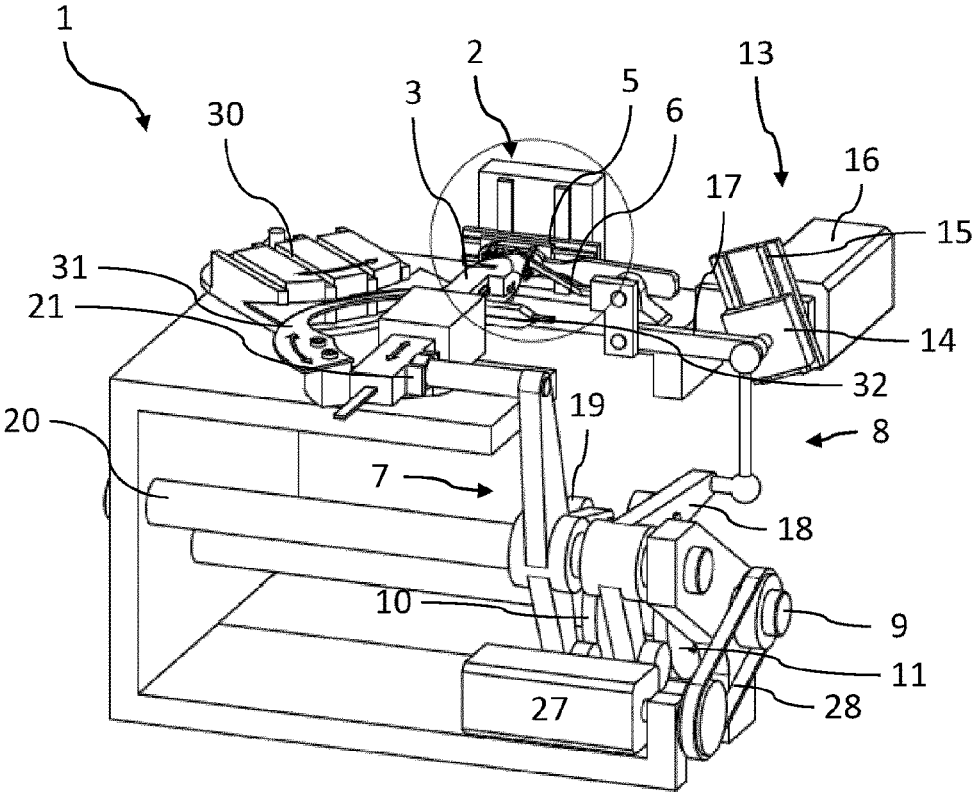
Figure 12:
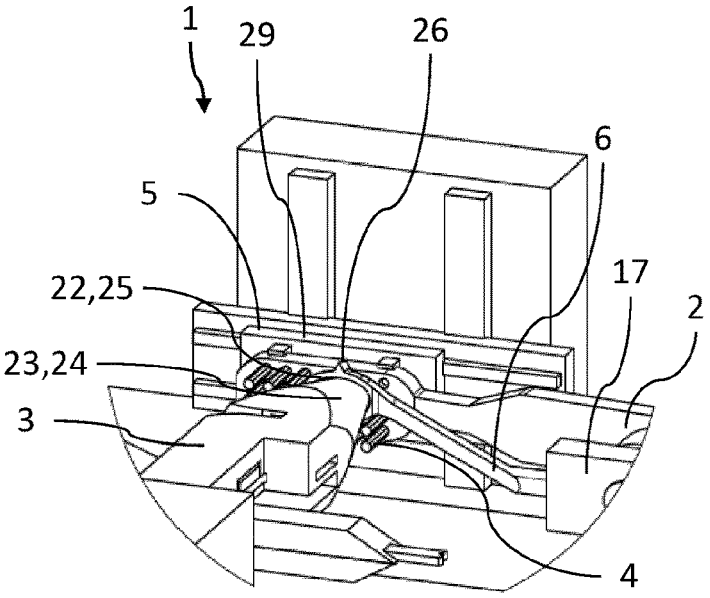
Figure 13:
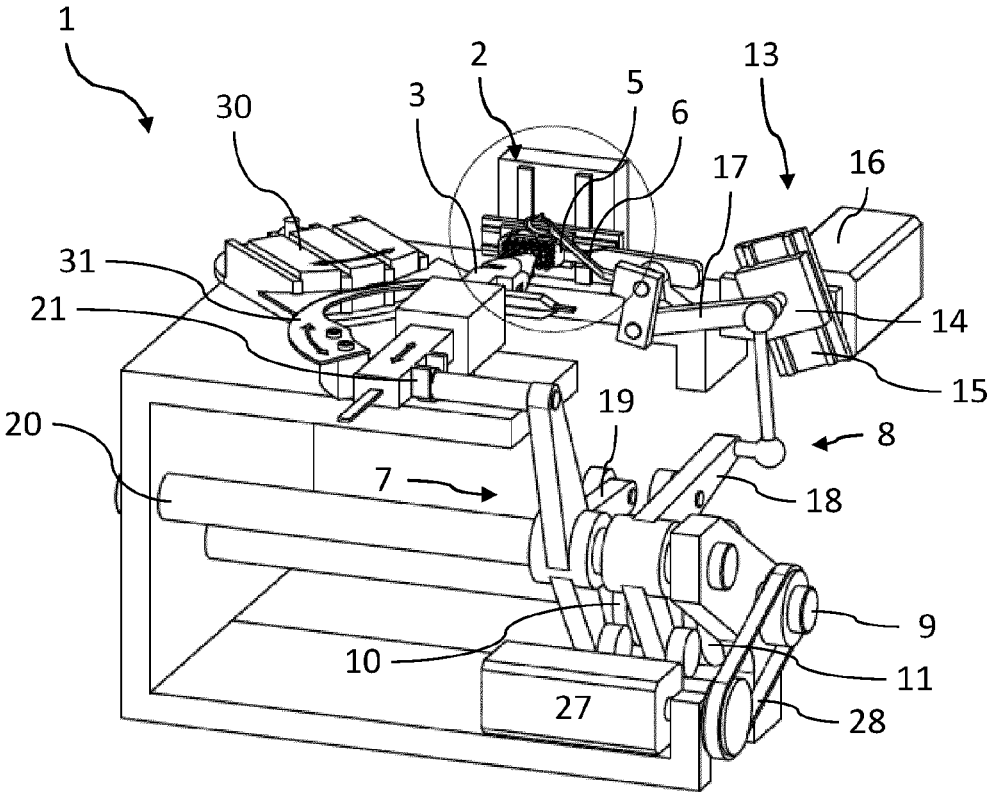
Figure 14:
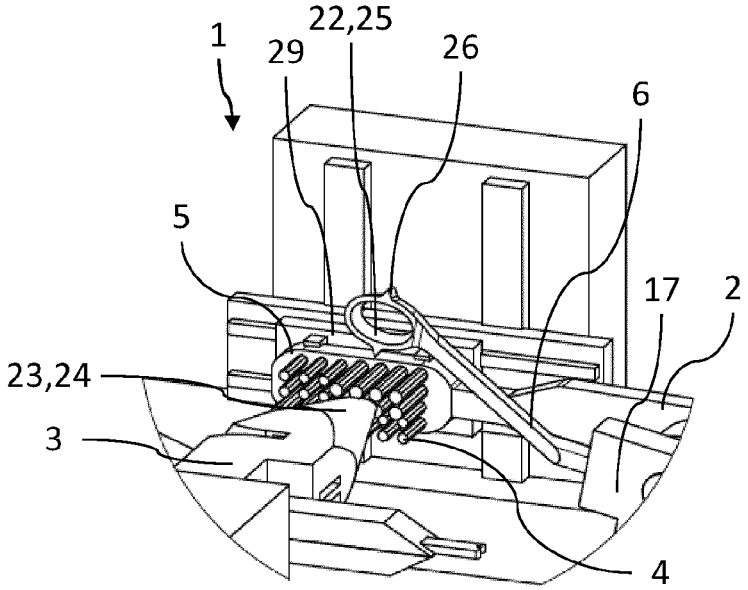
Figure 15:
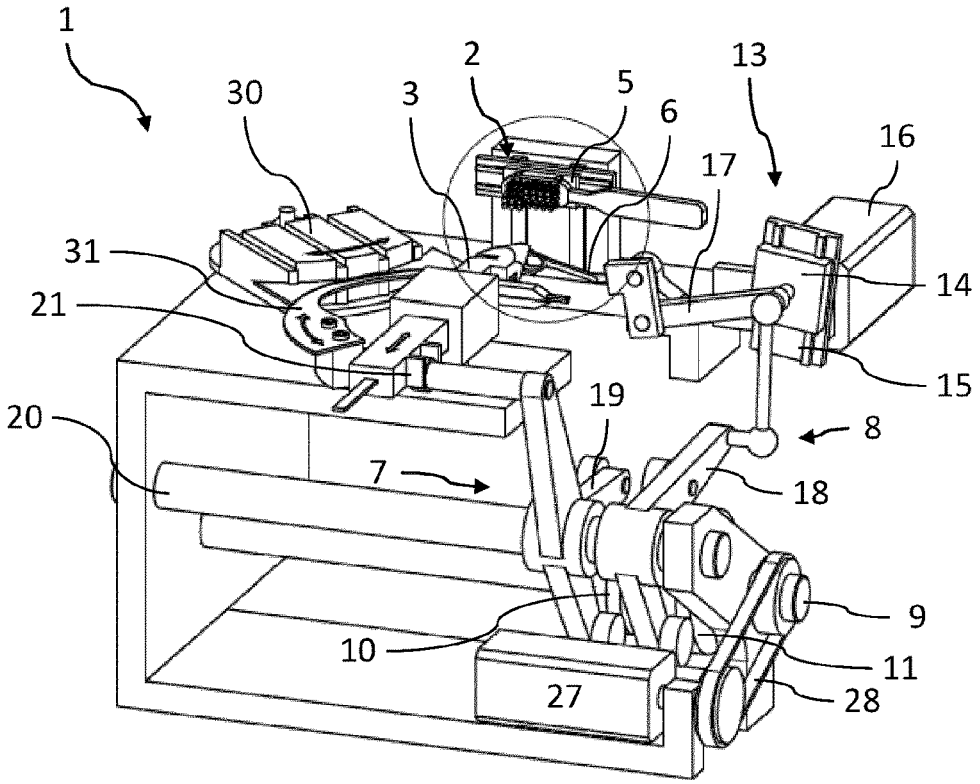
Figure 16:
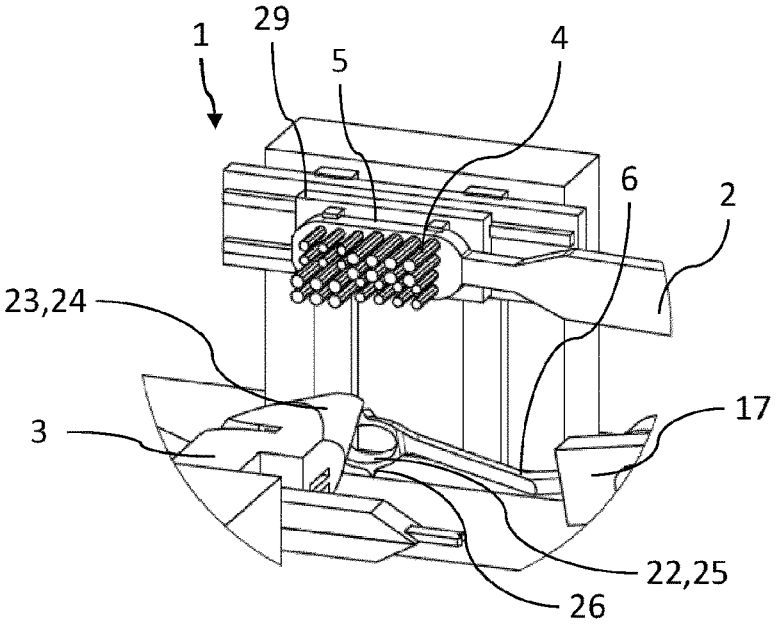
Figure 17:
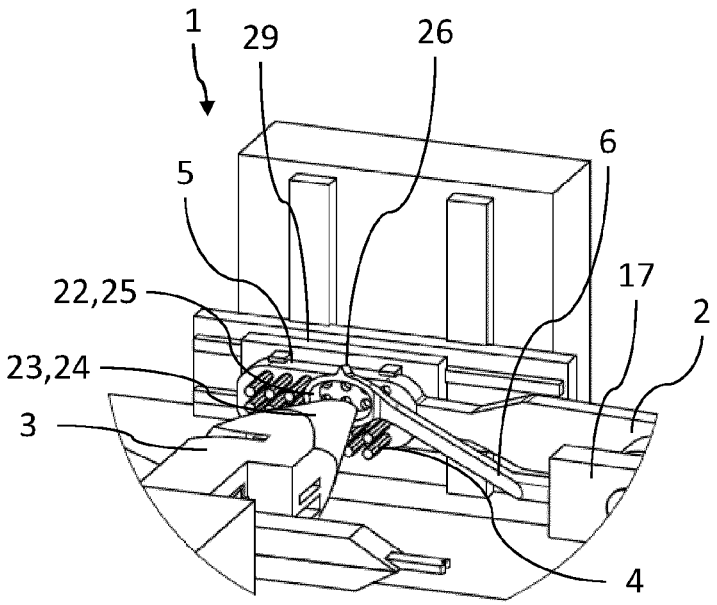

All the figures show an apparatus, denoted as a whole by 1, for producing brushware 2. The brushware 2 which can be produced on the apparatus 1 shown in the figures is brushes, in particular toothbrushes.

The apparatus 1 has a tufting tool 3 for tufting bristle bundles 4 into a provided bristle carrier 5 of an item of brushware to be produced and has a bristle displacer 6 for displacing already tufted bristle bundles 4 from a tufting region of the tufting tool 3.

The method 1 is distinguished by the fact that the tufting tool 3, via a tool coupling gear mechanism 7, and the bristle displacer 6, via a displacer coupling gear mechanism 8, are connected to a common drive shaft 9 of the apparatus 1 and, via this, are jointly driven in a forcibly coupled manner. This means that the movements of the tufting tool 3 into a tufting position and the bristle displacer 6 into a displacer position as well as the return movements back into the respect starting position are coupled to one another. Whenever the tufting tool 3 is in a particular position of its movement cycle, the bristle displacer 6 has assumed a particular position in its movement cycle.

The tool coupling gear mechanism 7 comprises a tool eccentric 10. The displacer coupling gear mechanism 8 comprises a displacer eccentric 11. With the aid of the tool eccentric 10 and the displacer eccentric 11, a rotational movement of the drive shaft 9 can be transmitted indirectly to the tufting tool 3 and to the bristle displacer 6. The tool eccentric 10 and the displacer eccentric 11 are arranged on the common drive shaft 9 for this purpose.

For performing a displacer movement, the bristle displacer 6 is pivotable about an axis of rotation 12. According to FIGS. 18 and 19, the bristle displacer 6, according to embodiment of the apparatus 1, may be pivotable about an axis of rotation 12 which is oriented parallel to the movement direction of the tufting tool 3 (cf. FIG. 18) or else which is oriented transversely or at a right angle to the movement direction of the tufting tool 3 (cf. FIG. 19).

Figure 18:
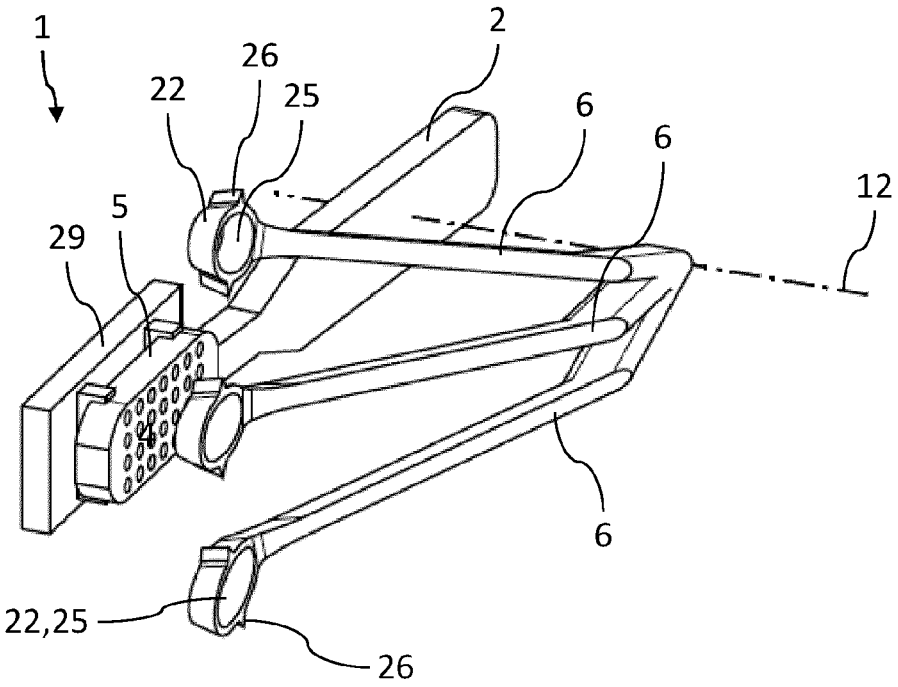
FIG. 18 shows a perspective illustration of a bristle displacer for illustrating a first movement pattern, in the case of which the bristle displacer is pivoted about an axis of rotation which is oriented parallel to the movement direction of the tufting tool during the tufting process.

Depending on orientation of the axis of rotation 12, the bristle displacer 6 then follows a fan-like displacer movement, as can be seen from the three different positions of a bristle displacer 6 in FIG. 18. Alternatively, the bristle displacer 6 is pivoted about an axis of rotation 12 which is oriented transversely or at a right angle to the movement direction of the tufting tool 3, which then results in an arc-shaped or circular-arc-shaped displacer movement, which is illustrated in FIG. 19.

In the case of the exemplary embodiment of a bristle displacer 6 that is shown in FIG. 18, it can also be said that the axis of rotation 12 of the bristle displacer 6 is oriented at a right angle or transversely to a longitudinal extent of the bristle displacer 6.

Figure 19:
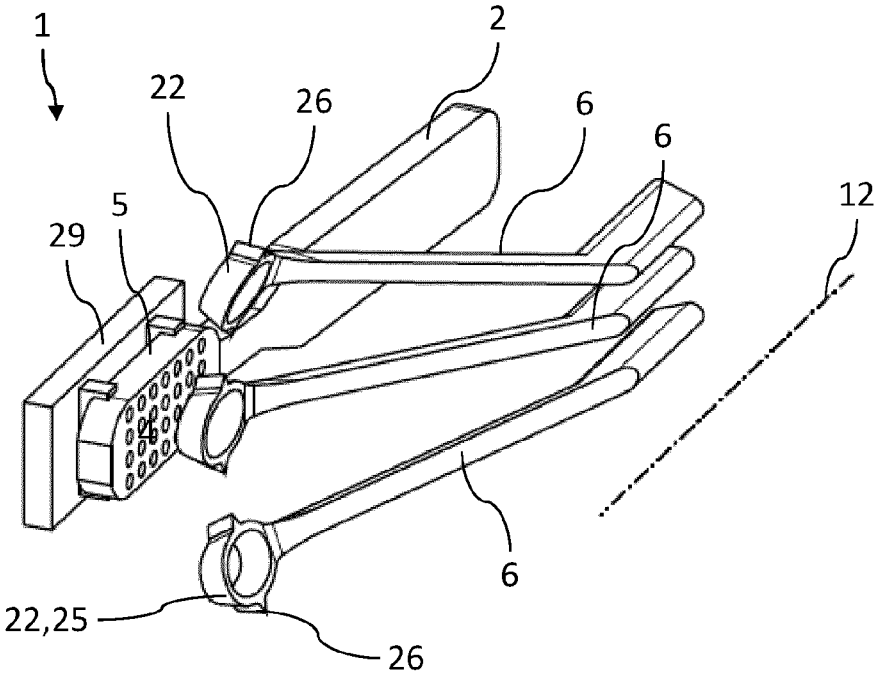
FIG. 19 shows a second schematic illustration of a bristle displacer for illustrating a second movement pattern, in the case of which an axis of rotation about which the bristle displacer is pivotable is oriented transversely or at a right angle to the movement direction of the tufting tool during tufting-in of bristle bundles.
Figure 20:
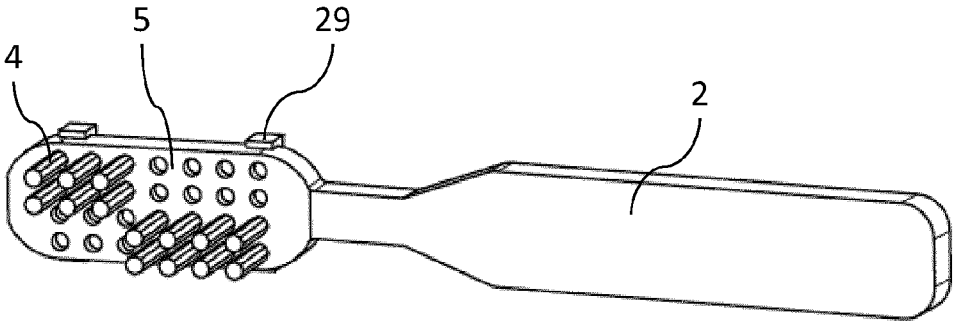
Figure 21:
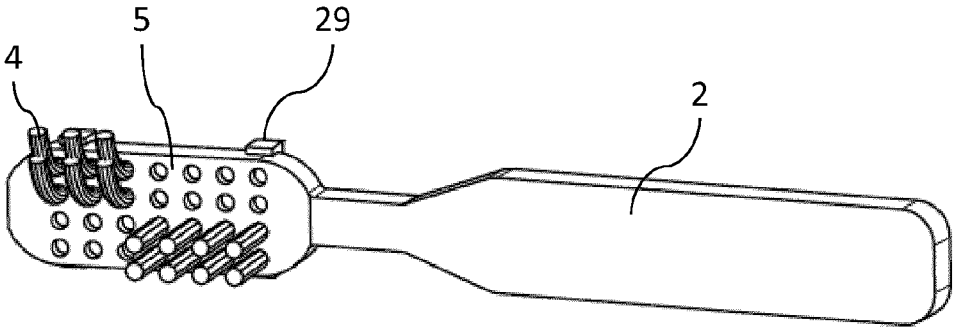
Figure 22:
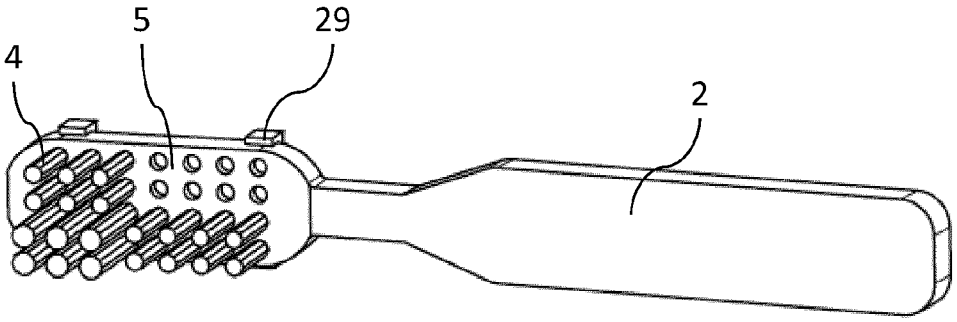
Figure 23:
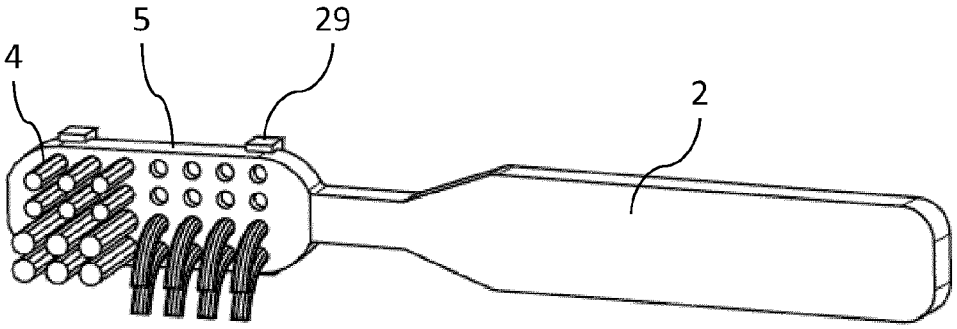
Figure 24:
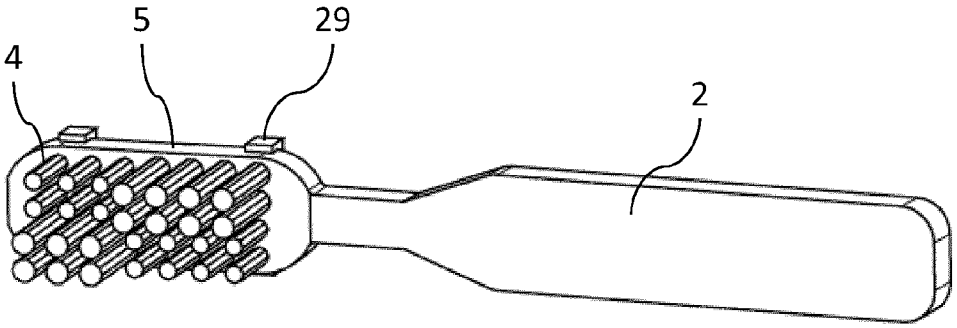

In the case of the exemplary embodiment of a bristle displacer 6 that is shown in FIG. 19, it can also be said that the axis of rotation 12 is oriented in the direction of a longitudinal extent or longitudinal axis of the bristle displacer 6.

The apparatus 1 shown in FIGS. 1 to 17 comprises a switching device 13 for changing a displacer direction and/or a displacer travel of the bristle displacer. The switching device 13 makes it possible for the bristle displacer 6 to be able to be advanced into the tufting region of the tufting tool 3 from different directions.

According to FIGS. 1 to 8, the bristle displacer 6 is advanced from the bottom upward, which is made possible by a corresponding position of the switching device 13. In this way, a lower partial field of a bristle field of the bristle carrier 5 can be tufted with bristle bundles 4.

According to FIGS. 9 to 17, the bristle displacer 6, for displacing already tufted bristle bundles, is advanced from the top downward, which is likewise brought about by a corresponding switching position of the switching device 13. This facilitates tufting of an upper partial field of the bristle carrier 5 with bristle bundles 4.

The switching device 13 of the apparatus 1 shown in the figures comprises a guide carriage 14 and a linear guide 15. The guide carriage 14 can be displaced along the linear guide 15, wherein a movement of the guide carriage 14 is converted into a displacer movement of the bristle displacer 6.

An angular position of the linear guide 15 along which the guide carriage 14 is displaced is changeable in this case. This is made clear by comparison of FIGS. 1 to 8 with FIGS. 9 to 14 and 17.

For changing the angular position of the linear guide 15, the switching device 13 has an actuating drive 16 by way of which the linear guide 15 can be pivoted.

The displacer direction of the bristle displacer 6 is in this case dependent on the angular position of the linear guide 15 just as much as a displacer travel covered by the bristle displacer 6 is.

The guide carriage 14 is connected via at least one lever, specifically via at least one articulated lever 17, to the bristle displacer 6. A movement of the guide carriage 14 can be converted into a movement of the bristle displacer 6 via the articulated lever 17.

The guide carriage 14, for its part, is connected via a transmission means 18 of the displacer coupling gear mechanism 8, specifically via a transmission lever, and via the displacer eccentric 11 already mentioned above to the common drive shaft 9.

The transmission means 18 of the displacer coupling gear mechanism 8 and a transmission means 19 of the tool coupling gear mechanism 7 are arranged and rotatably mounted on a common spindle 20. Levers are used as transmission means 18 and 19.

The tool coupling gear mechanism 7 furthermore comprises a slotted guide 21 which is arranged on the tufting tool 3 and which serves for transmission of a drive movement to the tufting tool 3.

The tool eccentric 10 and the displacer eccentric 11 are configured, and arranged on the common drive shaft 9, in such a way that the bristle displacer 6 is arranged in the displacer position before and also while the tufting tool 6 is in the tufting position. This is made clear in particular by the illustration of the apparatus 1 according to FIG. 17.

The bristle displacer 6 has a displacer ring 22. The tufting tool 3 can project into said displacer ring 22 in the tufting position. This is made clear for example by FIGS. 6, 12 and 17.

These figures also clearly show that an outer circumferential surface 23 of a tool tip 24 of the tufting tool 3 is formed so as to correspond to an inner circumferential surface 25 of the displacer ring 22 of the bristle displacer 6.

The bristle displacer 6 moreover has two deflection means 26 which are in the form of displacer tips with laterally inclined displacer surfaces. With the aid of the deflection means 26 of the bristle displacer 6, it is possible for already tufted bristle bundles 4 and their bristles to be deflected laterally with respect to a movement direction of the bristle displacer 6. In this way, the bristle bundles 4 can be brought out of the tufting region of the tufting tool 3 in a particularly gentle manner. Longitudinal axes of the deflection means 26 are in this case oriented in the movement direction of the bristle displacer 6.

The two deflection means 26 are arranged on an outer side of the displacer ring 22 of the bristle displacer 6.

The apparatus 1 comprises a motor 27 for driving the common drive shaft, the output shaft of which is connected via a drive belt 28 to the drive shaft 9.

The apparatus 1 furthermore comprises a holder 29 for receiving a bristle carrier 5. The holder 29 can be adjusted relative to the tufting tool 3 in at least two different axes in order for the bristle carrier 5, for tufting of its receiving holes with bristle bundles 4, to be able to be positioned relative to the tufting tool 3.

The apparatus 1 furthermore has a magazine 30 in which bristle filaments are stored. The bristle filaments, with the aid of a bundle separator 31 of the apparatus 1, can, combined into bristle bundles 4, be removed from the magazine 30 and supplied to the tufting tool 3. The apparatus 1 furthermore has an anchor-supply apparatus 32 by way of which anchors, for fastening the bristle bundles 4 in the bristle carrier 5, can be supplied to the tufting tool 3.

The invention is concerned with improvements in the technical field of brushware production. For this purpose, an apparatus 1 which has a tufting tool 3 for tufting bristle bundles 4 into a provided bristle carrier 5 and has a bristle displacer 6 for displacing already tufted bristle bundles from a tufting region of the tufting tool 3 is proposed. The tufting tool 3 and the bristle displacer 6 are, via in each case one separate coupling gear mechanism 7 or 8, respectively, connected to and driven by a common drive shaft 9 of the apparatus.

LIST OF REFERENCE SIGNS

1 Apparatus for producing brushware
2 Item of brushware
3 Tufting tool
4 Bristle bundle
5 Bristle carrier
6 Bristle displacer
7 Tool coupling gear mechanism
8 Displacer coupling gear mechanism
9 Drive shaft
10 Tool eccentric
11 Displacer eccentric
12 Axis of rotation of 6
13 Switching device
14 Guide carriage
15 Linear guide
16 Actuating drive
17 Lever, articulated lever
18 Transmission means of 8
19 Transmission means of 7
20 Spindle
21 Slotted guide
22 Displacer ring
23 Outer circumferential surface of 24
24 Tool tip
25 Inner circumferential surface of 22
26 Deflection means
27 Motor
28 Drive belt
29 Holder
30 Magazine
31 Bundle separator
32 Anchor-supply apparatus

The invention claimed is:

1. An apparatus (1) for producing brushware (2), the apparatus comprising:

a tufting tool (3) for tufting bristle bundles (4) placed into a provided bristle carrier (5);

a bristle displacer (6) for displacing already tufted ones of the bristle bundles (4) from a tufting region of the tufting tool (3);

a common drive shaft (9);

a tool coupling gear mechanism (7) via which the tufting tool (3) is connected to and driven by the common drive shaft (9); and a displacer coupling gear mechanism (8) via which the bristle displacer (6) is connected to and driven by the common drive shaft (9).

2. The apparatus (1) as claimed in claim 1, wherein the tool coupling gear mechanism (7) comprises a tool eccentric (10) and the displacer coupling gear mechanism (8) comprises a displacer eccentric (11).

3. The apparatus (1) as claimed in claim 2, wherein the tool eccentric (10) and the displacer eccentric (11) are arranged on the common drive shaft (9).

4. The apparatus (1) as claimed in claim 1, wherein, for performing a displacer movement, the bristle displacer (6) is pivotable about an axis of rotation (12), and the axis of rotation (12) is oriented parallel or at a right angle or transversely to a movement direction of the tufting tool (3).

5. The apparatus (1) as claimed in claim 1, further comprising a switching device (13) for changing at least one of a displacer direction or a displacer travel of the bristle displacer (6).

6. The apparatus (1) as claimed in claim 5, wherein the switching device (13) comprises a guide carriage (14) and a linear guide (15) along which the guide carriage (14) is displaceably mounted, and an angular position of the linear guide (15) is changeable.

7. The apparatus (1) as claimed in claim 6, wherein the switching device (13) has an actuating drive (16) for changing the angular position of the linear guide (15).

8. The apparatus (1) as claimed in claim 6, wherein at least one of the displacer direction of the bristle displacer (6) or the displacer travel of the bristle displacer (6) is dependent on the angular position of the linear guide (15).

9. The apparatus (1) as claimed in claim 6, wherein the guide carriage (14) is connected via at least one lever to the bristle displacer (6).

10. The apparatus (1) as claimed in claim 6, wherein the guide carriage (15) is connected via at least one of a transmission element (18) of the displacer coupling gear mechanism (8) or the displacer eccentric (11) to the common drive shaft (9).

11. The apparatus (1) as claimed in claim 10, wherein the transmission element (18) of the displacer coupling gear mechanism (8) and a transmission element (19) of the tool coupling gear mechanism (7) are arranged on a common spindle (20).

12. The apparatus (1) as claimed in claim 1, wherein, wherein the tool coupling gear mechanism (7) has a slotted guide (21) for transmission of a drive movement to the tufting tool (3).

13. The apparatus (1) as claimed in claim 1, wherein the tool coupling gear mechanism (7) comprises a tool eccentric (10) and the displacer coupling gear mechanism (8) comprises a displacer eccentric (11), the tool eccentric (10) and the displacer eccentric (11) are configured, and arranged on the common drive shaft (9), such that the bristle displacer (6) is arranged in the displacer position while the tufting tool (3) is in the tufting position.

14. The apparatus (1) as claimed in claim 1, wherein the bristle displacer (6) has a displacer ring (22) into which the tufting tool (3) projects in the tufting position.

15. The apparatus (1) as claimed in claim 14, wherein an outer circumferential surface (23) of a tool tip (24) of the tufting tool (3) is formed so as to correspond to an inner circumferential surface (25) of the displacer ring (22).

16. The apparatus (1) as claimed in claim 1, wherein the bristle displacer (6) has at least one deflection element (26) by which the bristle bundles (4) are able to be deflected laterally with respect to a movement direction of the bristle displacer (6).

17. The apparatus (1) as claimed in claim 1, further comprising a motor (27) for driving the common drive shaft (9).

18. The apparatus (1) as claimed in claim 1, further comprising a holder (29) for receiving the bristle carrier (5), and the holder is adjustable relative to the tufting tool (3) in a t least two different axes.

* * * * *